United States Patent [19]

Jensen

[11] 3,963,414

[45] June 15, 1976

[54] APPARATUS FOR SEQUESTERING COMBUSTION GAS OF AN OPEN BURNER

[76] Inventor: Fred H. Jensen, 172 W N. Camano Drive, Camano Island County, Wash. 98292

[22] Filed: Dec. 9, 1974

[21] Appl. No.: 531,210

Related U.S. Application Data

[60] Division of Ser. No. 339,936, March 9, 1973, abandoned, which is a continuation-in-part of Ser. No. 247,722, April 26, 1972, Pat. No. 3,799,142.

[52] U.S. Cl. ..... 431/329; 126/86; 126/92 AC; 126/299 B

[51] Int. Cl.[2] ..... F23D 13/14

[58] Field of Search..... 431/328, 329; 126/92 R, 126/92 B, 92 AC, 92 C, 299 R, 299 B, 86; 98/115 K; 236/16, 93

[56] References Cited

UNITED STATES PATENTS

| | | | |
|---|---|---|---|
| 3,187,741 | 6/1965 | Oatley | 126/92 AC |
| 3,270,798 | 9/1966 | Ruff | 431/329 |
| 3,366,333 | 1/1968 | Diehl | 236/93 |
| 3,591,322 | 7/1971 | Derringer et al. | 431/78 |
| 3,650,262 | 3/1972 | Root et al. | 126/110 R |

*Primary Examiner*—William E. Wayner
*Assistant Examiner*—William E. Tapolcai, Jr.
*Attorney, Agent, or Firm*—Robert W. Beach

[57] ABSTRACT

Combustion gas flowing alongside a surface of an open burner, such as over the upright catalytic bed of a space heater or a generally horizontal surface such as the top plate of a space heater, is segregated by an aperture in the path of flow of the combustion gas, so that the gas flows through such aperture instead of being dissipated into a room space and mixed with the ambient air of the space. The effluent combustion gas thus sequestered is withdrawn by suction through a discharge duct. The opening through such aperture or discharge duct can be regulated by a shutter or damper, which can be adjusted by a thermostat responsive to the temperature of gas flowing through the segregating aperture or discharge duct, to enlarge the duct opening as the temperature rises and to restrict the opening as the temperature decreases.

5 Claims, 18 Drawing Figures

Fig. 6.
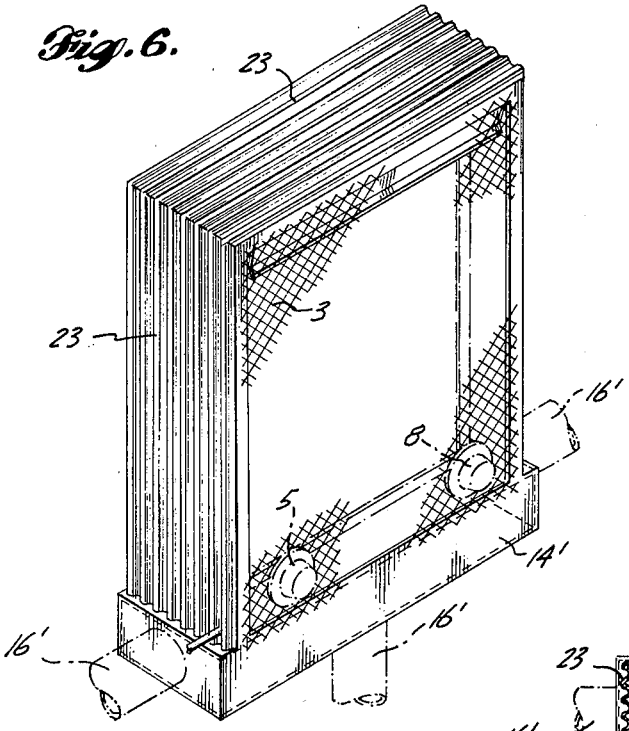
Fig. 7.
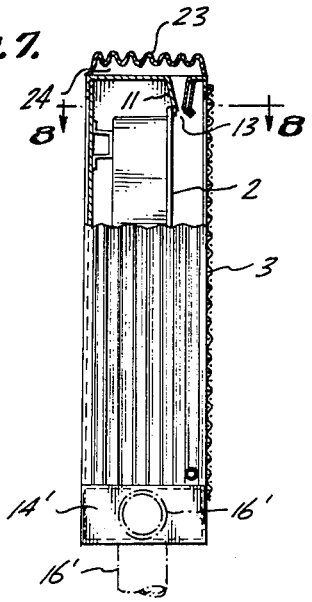
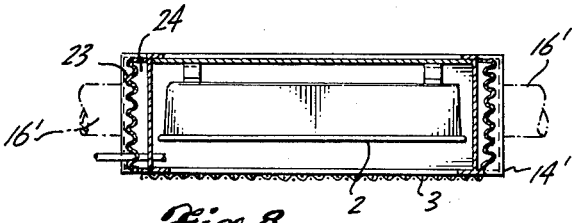
Fig. 8
Fig. 11.
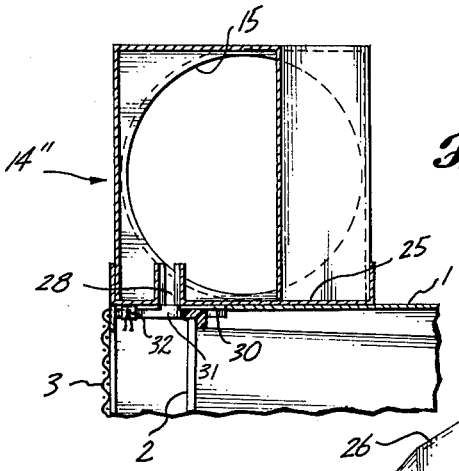
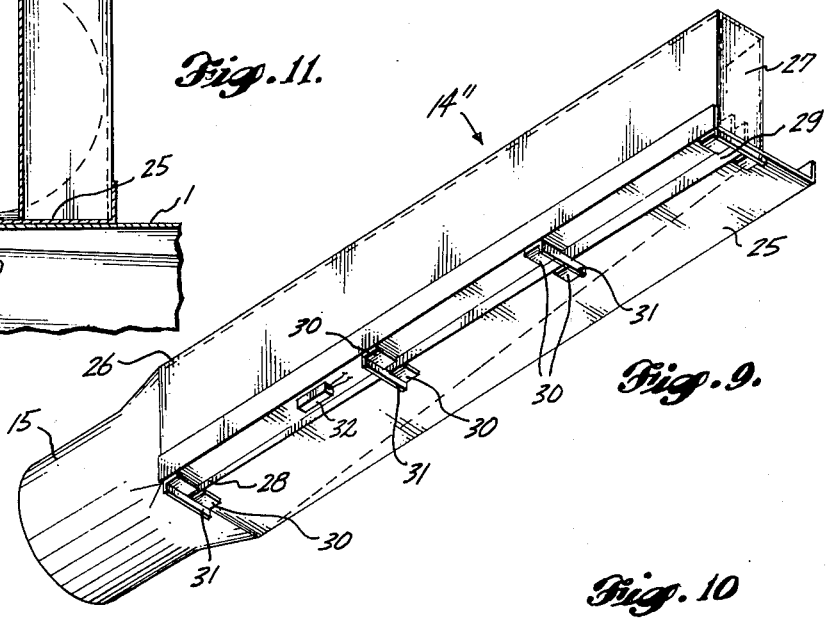
Fig. 9.
Fig. 10
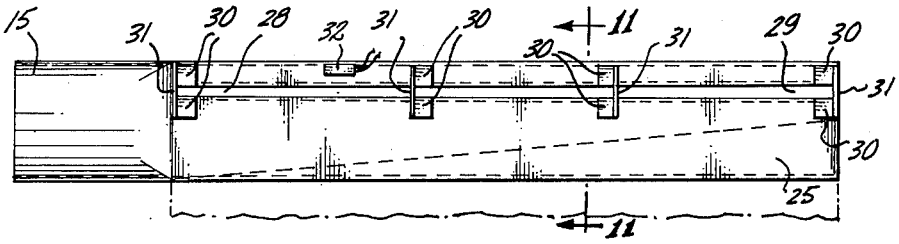

Fig. 12.
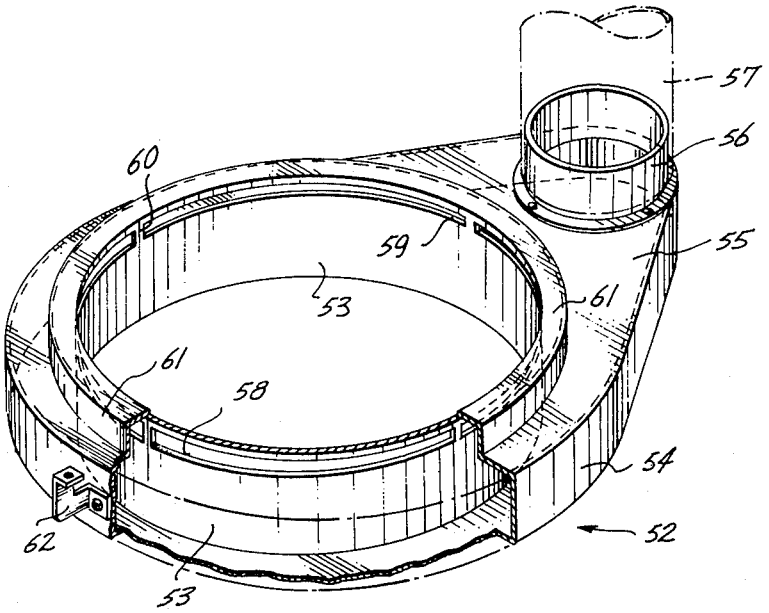
Fig. 14.
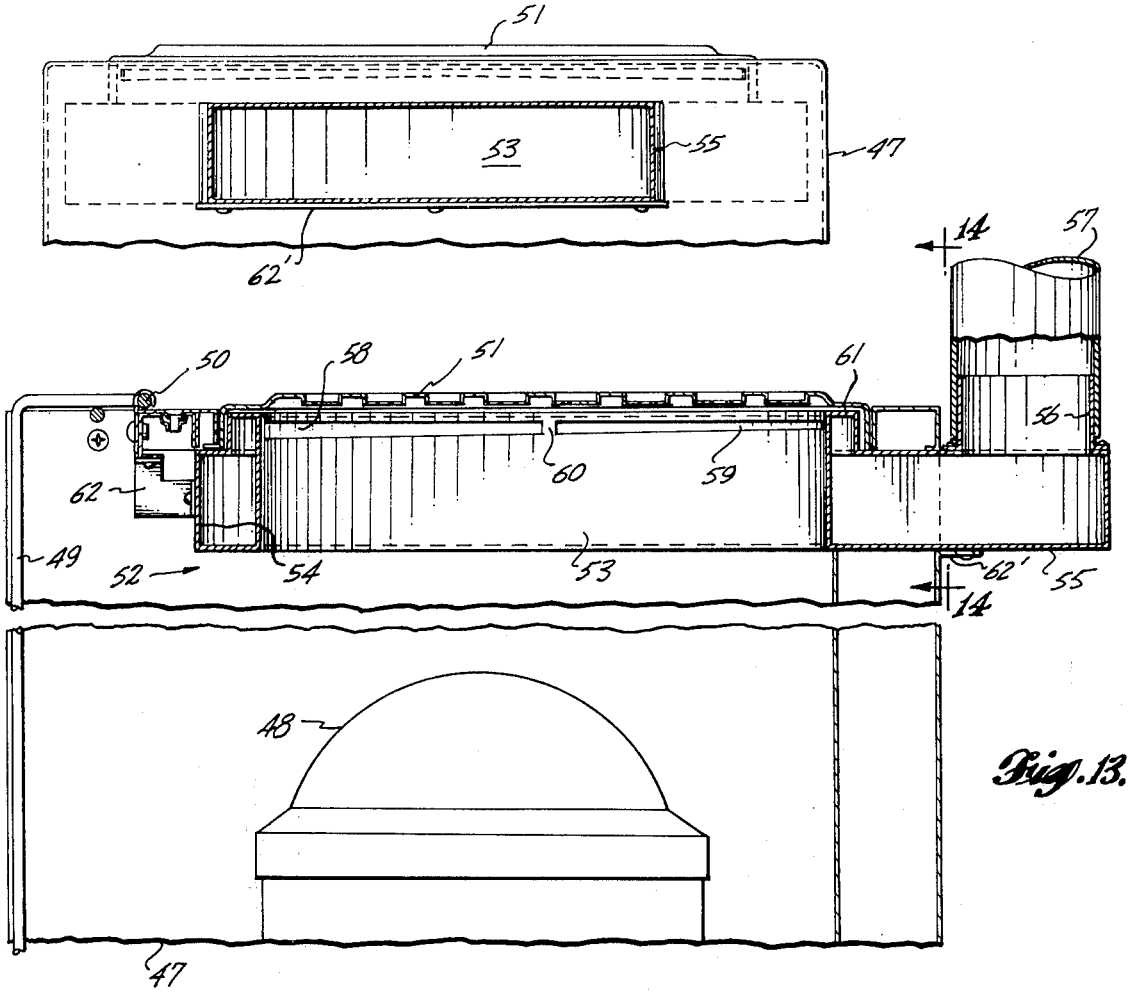
Fig. 13.

APPARATUS FOR SEQUESTERING COMBUSTION GAS OF AN OPEN BURNER

This application is a division of my application Ser. No. 339,936, filed Mar. 9, 1973, now abandoned, for Method For Sequestering Open Flame Combustion Gas, which is a continuation-in-part of my application Ser. No. 247,722, filed Apr. 26, 1972, for Method and Apparatus for Sequestering Open Flame Combustion Gas, issued as U.S. Pat. No. 3,799,142. The apparatus of the present invention is concerned with segregating combustion gas from and avoiding oxygen depletion in a living space affected by an open burner used for warming such space.

A catalytic bed space heater using either combustible gas, such as butane or propane, or a gas-forming liquid hydrocarbon, such as gasoline, or some other liquid which forms a combustible gas, such as methyl alcohol, provides a compact, convenient and attractive space heater. Two principal difficulties have been experienced with such heaters: the production of excessive condensation in the space being heated and the accompanying accumulation of products of combustion in such space, which may include noxious gases.

Gas, gasoline or alcohol fired space heaters customarily are used in confined spaces, such as in a boat cabin, in a house trailer, or in a camper. Because the volume of such spaces is comparatively small and such vehicles usually have rather large windows, annoying condensation of water vapor on cold surfaces occurs. Since the products of combustion of such gas, hydrocarbon liquid, or alcohol are principally water and carbon dioxide, condensation necessarily follows after a condition of maximum humidity has been reached. Moreover, the products of combustion will tend to include carbon monoxide, which is noxious, instead of carbon dioxide.

A principal object of the present invention, therefore, is to sequester effectively the substantially smokeless gaseous combustion products formed by the combustion of an open burner and unburned hydrocarbons and prevent them from entering the confined space in which the burner is located. A companion object is, by removing such products of combustion, to enable them to be replaced by admission of outside air to the living space in which the burner is located for which room would not otherwise be available. The effect of such combustion gas sequestration is to eliminate condensation within the space in which the burner is located, to reduce drastically the combustion products in the air of such space, and to improve ventilation of the space.

Another object is to remove substantially smokeless gaseous combustion products from the space in which a burner is located with minimum reduction in the efficiency of combustion and space heating.

It is also an object to sequester effluent combustion gas produced by a burner with apparatus of simple and economical construction, which is easy to install and maintain.

FIG. 6 is a top perspective of a somewhat modified type of space heater;

FIG. 7 is an edge elevation of such heater, with parts broken away, and

FIG. 8 is a horizontal section through the space heater taken on line 8—8 of FIG. 7.

FIG. 9 is a bottom perspective of an alternative type of plenum chamber for a catalytic space heater which can be applied to a heater of the type shown in FIGS. 1, 2 and 3;

FIG. 10 is a bottom plan of such plenum chamber, and

FIG. 11 is a vertical section through such a plenum chamber installed on a space heater and having parts broken away.

FIG. 12 is a top perspective of an annular effluent gas-sequestering plenum chamber, parts being broken away, and FIG. 13 is a vertical section through such effluent gas-sequestering chamber shown installed in a space heater.

FIG. 14 is a vertical section through the plenum chamber, taken on line 14—14 of FIG. 13.

Figure 1:
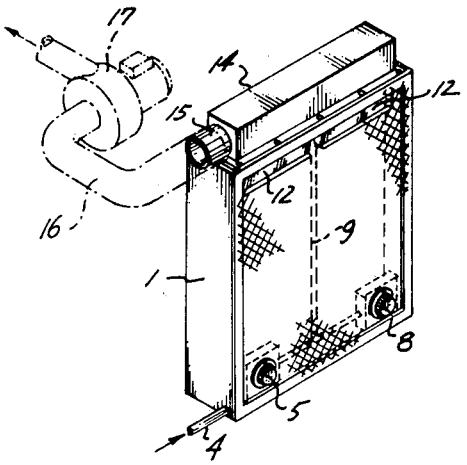
FIG. 1 is a top perspective of a catalytic space heater incorporating the invention.
Figure 2:
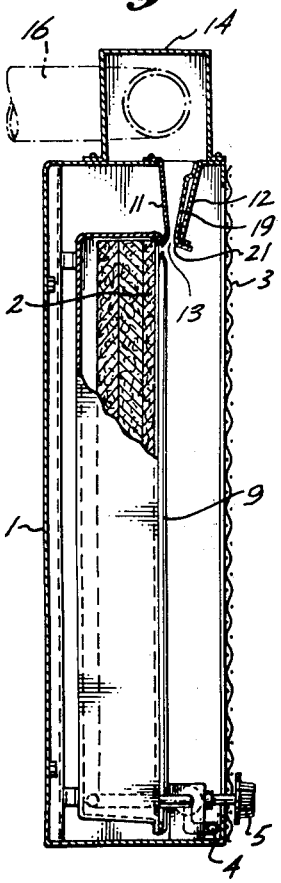
FIG. 2 is a vertical section through such space heater with parts broken away.

The most important utilization of the present invention is in connection with a conventional open burner such as a gas-fired catalytic space heater, an example of which is shown in FIGS. 1 and 2. Such a heater includes a casing 1 housing the catalytic bed 2 which may be a bed of asbestos or other heat-resistant inert mineral to which bed a very thin coating of platinum group metal has been applied to serve as a catalyst. Use of such a catalyst enables gas supplied to the catalytic bed to burn at the radiating face of the bed at a lower temperature than would otherwise be required for combustion of the gas. The heat of the burning gas is radiated through a grill 3, and, normally, the substantially smokeless effluent gaseous products of combustion also pass through such grill and are dissipated in the living space in which the heater is located.

Figure 3:
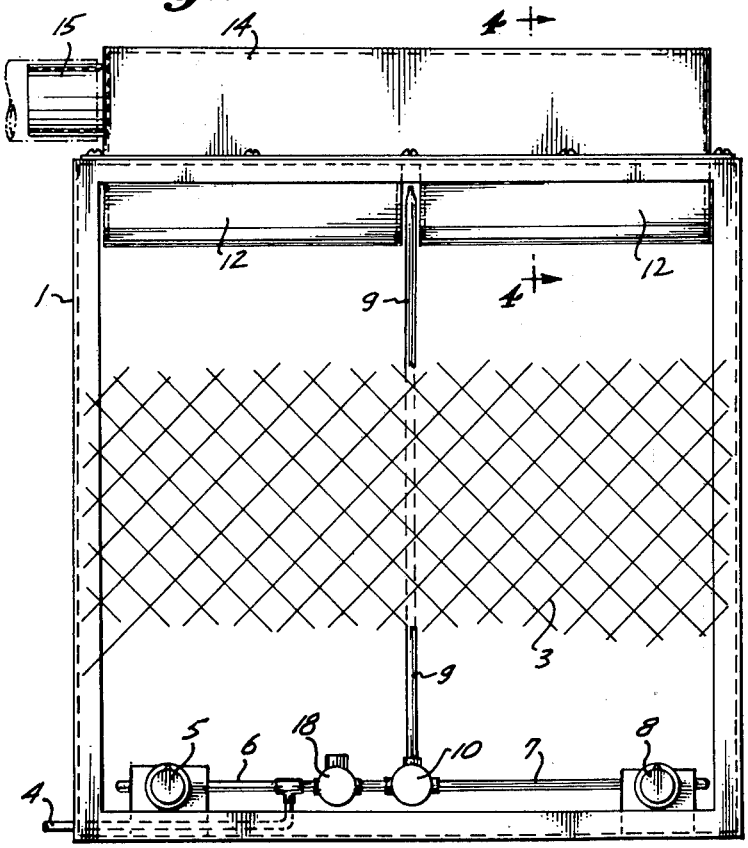
FIG. 3 is a front elevation of such heater with parts broken away.

The catalytic bed space heater shown in FIGS. 1, 2 and 3 of the drawings is typical and representative of such conventional space heaters, except for the application of the present invention to such a heater. Conventional features of such a heater include the gas supply pipe 4 connected to a starting valve 5 by conduit 6, which valve can be opened to provide a larger supply of gas to the catalytic bed for starting purposes than would be required under normal operating conditions. Another branch 7 of the gas supply line supplies gas to the heat intensity control valve 8, which is manually controlled for low, medium and high heat. A temperature-responsive tube 9 controls a safety shutoff valve 10 arranged in the conduit 7 leading from the gas supply pipe 4 to the control valve 8.

The normal catalytic bed space heater described radiates heat into the room from an unconfined sheet flow of substantially smokeless hot combustion gas moving upward alongside the bed 2 and substantially completely openly exposed to the room living space over the full height of such bed and the hot combustion gas also is allowed to escape into the room and to comingle with the air in it because it is substantially smokeless. While such combustion gas supplies heat to the space being heated, it also produces condensation, depletion of oxygen, and perhaps noxious gas, such as carbon monoxide, to a greater or lesser extent. The function of the present invention is to segregate the combustion gas and unburned hydrocarbons and lead them off to some location other than the space being heated by the space heater. By burning the gas at the face of the catalytic bed 2, the heat of the burning gas produces a convention current of combustion gas rising alongside the face of the catalytic bed in an unconfined sheet flow. All or most of such unconfined sheet gas flow can be segregated along the upper margin of the catalytic bed from the living space in which the burner is located and led out of the heater to another location, such as open atmosphere, instead of being commingled with the air of such space.

The laminar or sheet gas flow close alongside the catalytic bed may be referred to as the Coanda effect.

A construction effective to segregate from a room being heated gaseous combustion products flowing upward in a sheet alongside the face of the catalytic bed 2 includes an inner wall 11 and an outer wall 12 having their lower adjacent edges spaced apart to form an effluent combustion gas collector slot 13 which is closed at its ends. This slot provides communication between the interior of the heater casing 1 and a plenum chamber 14 extending across the top of such casing, as shown in FIGS. 2 and 3. From this plenum chamber, the effluent combustion gas is discharged, in a flow substantially unconstricted from the flow entering the slot 13, through an outlet 15 and discharge conduit 16 to the external atmosphere or some other disposal location. The effluent combustion gas is drawn from the plenum chamber through the duct 16 by suction produced by the exhaust fan or blower 17 or by wind-induced draft or by natural convection.

Particularly if considerable reliance is placed on an exhaust fan to lead off the combustion gas from the heater casing, it is desirable to provide suitable safety shutoff controls for the fuel supply mechanism. One such control may be a solenoid valve 18 provided in the conduit 7 between the gas supply pipe 4 and the control valve 8. If the exhaust fan or blower 17 should become inoperative for any reason, such as if the voltage of the current source for the fan-operating motor or the speed of the motor or the draft provided by the fan should be reduced below a predetermined valve, the solenoid valve 18 can shut off completely the supply of fuel to the catalytic bed. Alternatively, a voltage-sensitive relay could be employed, both to deenergize the fan motor and to effect closure of the solenoid valve 18 if the supply voltage to the motor decreases below a predetermined value.

If the flow of effluent gas induced into the slot 13 by the exhaust draft were sufficiently strong, air might be drawn from the space to be heated through the grill 3 and into the slot 13, in addition to the effluent combustion gas. Under these circumstances, heated air from the room would be needlessly wasted. To foreclose any such possibility, the area of the opening 13 could be altered, as might be required, so that substantially only the unconfined sheet flow of combustion gas will flow into the collector passage without any appreciable additional air. However, it is important that the area of the opening into the collector slot be sufficiently great so that as much as possible of the combustion gas will be segregated and pass into the gas collector passage.

Figure 4:
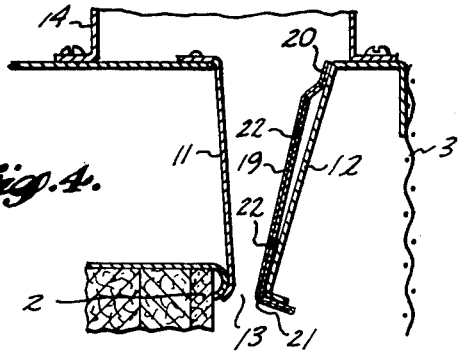
FIG. 4 is a fragmentary vertical section through a portion of the heater taken on line 4—4 of FIG. 3.

The temperature of the effluent combustion gas passing through the slot 13 decreases with increase of flow, and, conversely, increases with decrease of flow as a function of mixing of ambient air of the space being heated. It is therefore desirable to control the area of the slot 13 into the combustion gas collector plenum chamber in accordance with the temperature of such combustion gas. FIG. 4 shows the slot 13 opening between walls 11 and 12 as being relatively wide, as compared to the width of such slot in FIG. 5. The width of the slot opening shown in FIG. 4 would be appropriate for a condition in which the combustion gas was relatively hot, whereas the width of the opening shown in FIG. 4 would be appropriate when the combustion gas was relatively cool.

Alteration in the width of slot 13 can be effected by mounting in the slot a damper 19 for restricting such slot. Such damper can be of a length substantially equal to the full width of the catalytic bed 2, and the upper edge 20 of such damper can be secured to the upper portion of the outer slot wall 12. The lower portion of such damper, which may include a stiffening flange, forms a flow-controlling lip 21, which lip can be moved closer to or farther from the inner slot wall 11. Movement of such flow-controlling lip in response to the temperature of effluent combustion gas flowing through the slot 13 can be effected by making the damper 19 a thermo-sensitive bimetallic element, or providing a bimetal unit connected to effect swinging of the damper. Equalization of pressure on opposite sides of the damper plate can be effected by providing apertures 22 in the damper plate.

Figure 5:
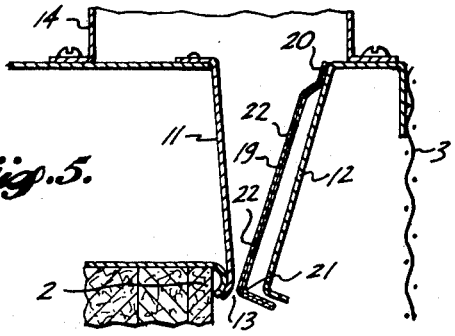
FIG. 5 is a similar view showing a component in a different operative position.

When the heat intensity control valve 8 is adjusted for a low flame condition, the temperature of the combustion gas passing through the slot 13 will be relatively low, so that the flow-controlling lip 21 of the damper 19 will be located close to the wall 11, as shown in FIG. 5, to restrict the opening into the flow-segregating slot.

On the other hand, if control valve 8 is turned to the high range to supply more combustible gas to the catalytic bed 2, the temperature of the effluent combustion gas passing into the collector slot 13 will be higher, which will activate the temperature-responsive means controlling the position of damper 19 to open the damper toward the position of FIG. 4. The gas-collector slot 13 will therefore be enlarged generally commensurate with the larger volume of the sheet flow containing the combustion gas produced, so that, again, at least most of the unconfined sheet flow moving upwardly over the face of the catalytic bed 2 will be segregated by passage through the slot 13 in its flow path and led away from the space being heated through the discharge duct 16 instead of escaping into the space being heated.

The heat resulting from the burning of the combustible gas at the surface of the catalytic bed 2 is of two types: first, the radiant heat projected from the catalytic bed into the space to be heated, and, second, the heat of the combustion gas. The quantity of heat of the first type is much greater than the quantity of heat of the second type. As has been mentioned above, the effect of the catalytic bed 2 is to enable the combustible gas to burn at the surface of the catalytic bed at a temperature considerably lower than the normal ignition temperature of the combustible gas. If the resulting combustion gas is sequestered from the heater casing 1 and exhausted, as described above, that portion of the heat resulting from the combustion which is retained in the effluent combustion gas will be wasted. While this proportion of the combustion heat is minor, it may be desirable to conserve at least some of such heat without the disadvantages of moisture condensation on surfaces in the space being heated, and contamination of such space by noxious components of the combustion gas.

FIGS. 6, 7 and 8 illustrate a catalytic bed space heater of the same type as shown and described in connection with FIGS. 1 to 5, inclusive, except that this heater has a heat exchanger for the purpose of salvaging heat from the sequestered effluent combustion gas. While various types of heat exchanger constructions could be used, FIGS. 6, 7 and 8 show a corrugated top heat exchange surface and side heat exchange surfaces 23 spaced outwardly from the top and sides, respectively, of the heater casing 1 to provide a passage 24 for effluent combustion gas.

The gas-collector slot 13 provides a passage between the interior of the heater adjacent to the catalytic bed 2 and the space between the top of the heater casing 1 and the jacket top 23, as shown in FIG. 7. The opposite ends of such space are in communication with the upper ends of the spaces at opposite sides of the heater between the heat exchanger jacket sides 23 and the sides of the heater casing 1. The lower ends of the side passages open into a plenum chamber 14' beneath the heater. An effluent combustion gas discharge duct can be connected to the plenum chamber at any location, such as the duct 16' which can be connected to the bottom of the plenum chamber or to either end of the plenum chamber.

In a heater having a heat exchanger of the type shown in FIGS. 6, 7 and 8, it is more important that an exhaust fan or blower be connected to the discharge duct, as indicated in FIG. 1, to provide an exhaust draft for insuring that the combustion gas flows through the collector slot 13 and the heat exchanger passage instead of being discharged into the space being heated. The amount of heat extracted from the effluent combustion gas passing through the heat exchanger passage and conducted through the walls 23 will, of course, radiate to the space being heated and supplement that heat produced by direct radiation from the combustion of the gas at the surface of the catalytic bed.

The modified effluent combustion gas collector plenum chamber 14'' shown in FIGS. 9, 10 and 11 can be applied to a catalytic space heater of the type shown in FIGS. 1 to 3, inclusive, instead of the plenum chamber 14 shown in those figures. In applying this plenum chamber, an adaptor plate 25 is secured to the top of the heater casing 1 as shown in FIG. 11. The plenum chamber tapers from a wide end 26 connected to the outlet duct 15 toward a narrow end 27. The height of the plenum chamber can be constant, and the taper of the chamber preferably is uniform and corresponds generally to the cumulative flow of gas from the heater into the plenum chamber through the access slot 28, 29 in the adaptor plate 25.

The elongated access slot from the heater to the plenum chamber 14 extends substantially the full length of the plenum chamber and the full width of the catalytic bed 2 of the heater and extends along the upper margin of the catalytic bed. There is no space between the catalytic bed margin and the plenum chamber 14'' through which air may flow to mix with the gaseous combustion products. In order for the sheet of gas flowing upward alongside the catalytic bed to pass uniformly across its entire width into the plenum chamber which tapers in plan as discussed above, the access slot in the adaptor plate 25 is tapered in width toward the outlet 15 in the direction opposite the taper of the plenum chamber, that is from a wide end 29 to a narrow end 28. The degree of taper of the slot will correspond generally to the degree of taper of the plenum chamber plan, but will be in the opposite direction. The taper of the plenum chamber is designed so the velocity of the effluent gases through this plenum chamber is approximately constant.

If the gas velocity is constant, the opposite taper of the slot should be such as to achieve essentially uniform quantitative flow through slot 13 into the plenum chamber throughout its length. Such uniform flow is desirable to ensure efficient removal of essentially all of the products of combustion but at the same time to minimize removal of ambient room air.

In order to connect the portions of the adaptor plate 25 at opposite sides of the access slot 28, 29 and to brace such plate sections adequately, these sections are structurally connected at locations spaced lengthwise of the slot 28, 29. The connectors are shown as angle members having sections 30 of one flange bonded to the portions of the adaptor plate 25 at opposite sides of the slot 28, 29, respectively. The other flange 31 of each angle connector bridges the access slot and connects the flange sections 30. The flange section 31 serves as a beam to deter relative deflection of the sections of adaptor plate 25 at opposite sides of the access slot with minimum obstruction to the flow of combustion gas from the heater through the collector slot into the plenum chamber.

If the exhaust blower 17 for drawing gas from outlet 15 should become inoperative for any reason such as mentioned above in connection with FIG. 3, the flow of gas through slot 28, 29 will decrease and the temperature of the gas adjacent to the slot will increase. This phenomenon can be used to activate a fail-safe mechanism controlling a solenoid shutoff valve 18 shown in FIG. 3. The increased temperature of the gas adjacent to the slot 28, 29 is sensed by a temperature-sensitive device 32 located at the living space side of the slot 28 as shown in FIGS. 9, 10 and 11. The link from the temperature-sensitive device to the solenoid valve 18 may be electro-mechanical, electrical of mechanical. Alternatively a temperature-responsive fluid-filled bulb is corrected by a capillary tube to a pressure-operated safety shut-off valve 18, instead of such valve being controlled by a solenoid.

While the effluent combustion gas sequestering mechanism has been illustrated in FIGS. 1 to 11 as being applied to a radiant catalytic bed type of heater, corresponding mechanism can be provided for heaters of other types. In FIGS. 12 to 18 mechanism for sequestering combustion gas is shown as being applied to a central burner type of radiant space heater which conveniently may burn kerosene. The heater casing 47 houses the burner 48 as shown in FIG. 13. The front of the casing is covered by a series of thin upright parallel rods 49 having their upper ends attached to a horizontal rod 50 which is pivotably mounted to serve as a hinge about which the rods 49 can swing open, so that heat is radiated from the combustion gas directly into the living space through such casing front from an unconfined upward flow substantially completely openly exposed to the living space.

The central portion of the casing top is closed by a lid 51 having a circular recess beneath it into which the upper portion of an effluent combustion gas collector ring 52 can fit. The plenum chamber is formed between an inner cylindrical wall 53 and an outer wall 54 disposed generally, but not exactly, concentrically with the inner wall. One portion of the outer wall projects a consider-able distance rearward eccentrically of the ring 53 to serve as the base for an outlet pipe. A flange 56 encircling an aperture in the projecting portion 55 projects upward from such portion into the lower end of the out-let pipe 57.

The cross-sectional area of the plenum chamber tubular ring increases from the portion opposite the projection 55 toward such projection by divergence between the inner wall 53 and the outer wall 54. Combustion gas is drawn into the plenum chamber ring through slots in the upper portion of inner wall 53. The slots taper in width around both sides of such wall from the widest portion 58 opposite the projection 55 to the narrowest portion 59 adjacent to such projection. Connecting strips 60 bridging across the slot are provided at intervals spaced circumferentially of the ring to connect the portions of the inner wall above and below the slot. Also the outer wall can be stepped to provide an upper outer wall portion 61 that is precisely concentric with the inner wall 53 of the collector ring to provide a narrow upper portion that will fit into the recess of the casing cover 51.

The collector ring 52 with the flange 56 removed can be installed in the upper portion of the heater casing by inserting the ring through the front of the heater casing when the rods 49 are swung upward about the hinge rod 50. The projection 55 is moved rearwardly through an opening in the back of the casing until the outlet aperture is located behind the casing. The collector ring can be secured in this position by an angle bracket 62 connecting the portion of the ring remote from the projection 55 to the pivot rod 50, as shown in FIG. 13, and by connecting the bottom of the eccentric portion 55 to a tab 62' projecting from the back of the casing. The flange 56 can then be secured to the top of the projecting part 55 of the casing and the outlet duct 57 installed over the flange, as shown in FIG. 13.

Figure 17:
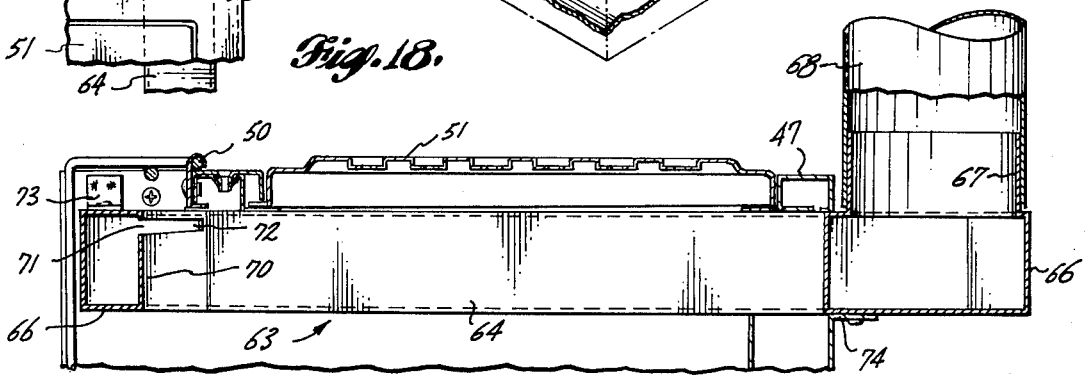
FIG. 17 is a vertical section through such plenum chamber taken on line 17—17 of FIG. 15, shown installed in a space heater.
Figure 17:
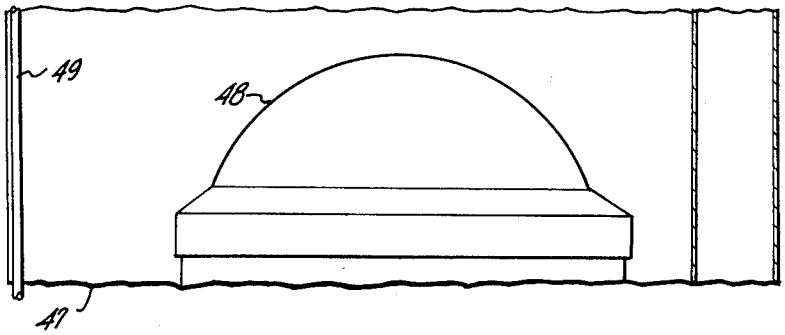

The effluent combustion gas collector plenum chamber of rectangular plan form shown in FIGS. 15 to 18 can be installed in a central burner space heater of the same type as shown in FIG. 13, in a manner illustrated in FIG. 17. The collector plenum chamber 63 includes opposite side portions 64 spaced apart by the front section 65 and the rear section 66 a distance such that the plenum chamber can be inserted into the burner casing between its opposite side walls.

Figure 18:
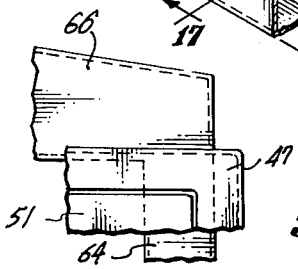
FIG. 18 is a fragmentary plan of a corner portion of the plenum chamber shown in FIG. 15, installed in a space heater such as illustrated in FIG. 17.

The front section 65 and the two side sections 64 of the plenum chamber can be inserted into the upper portion of the heater casing 47 through a slot in its back wall until the rear section 66 lies closely adjacent to the back wall of the heater casing and the side sections extend into the upper portion of the heater casing as shown in the rear top corner structure of FIG. 18. In this position a cylindrical flange encircling the outlet aperture in the rear section 66 can receive the lower end of the outlet conduit 68. Effluent combustion gas is drawn into the plenum chamber through a slot in the upper portion of the inner wall 69 of its front section 65.

In order to draw effluent combustion gas into the front section of the plenum chamber in a substantially uniform quantity across the length of the front section, such front section is tapered in plan from its opposite ends to its central portion 70. The slot through which the effluent combustion gas enters the plenum chamber is tapered oppositely from its central portion 71 to its end portions 72 adjacent to the side portions 64 of the plenum chamber. Thus the width of the gas entrance slot is greatest where the cross-sectional area of the plenum chamber is smallest, and the entrance slot is more restricted where the cross-sectional area of the plenum chamber is greater.

The effluent combustion gas plenum chamber of rectangular plan is secured in the upper portion of the heater casing 47 by angle brackets 73 connecting the forward corners respectively to the side walls of the heater casing. A tab 74 projecting from the rear wall of the heater casing beneath the rear section 66 can be secured to the bottom of such rear section to prevent movement of the plenum chamber out of the casing slot. One tab 74 can be provided at the central portion of the section 66 or two tabs can be provided adjacent to opposite ends of the rear section of the plenum chamber. Such brackets and tabs can be connected removably to the plenum chamber by sheet metal screws.

Figure 15:
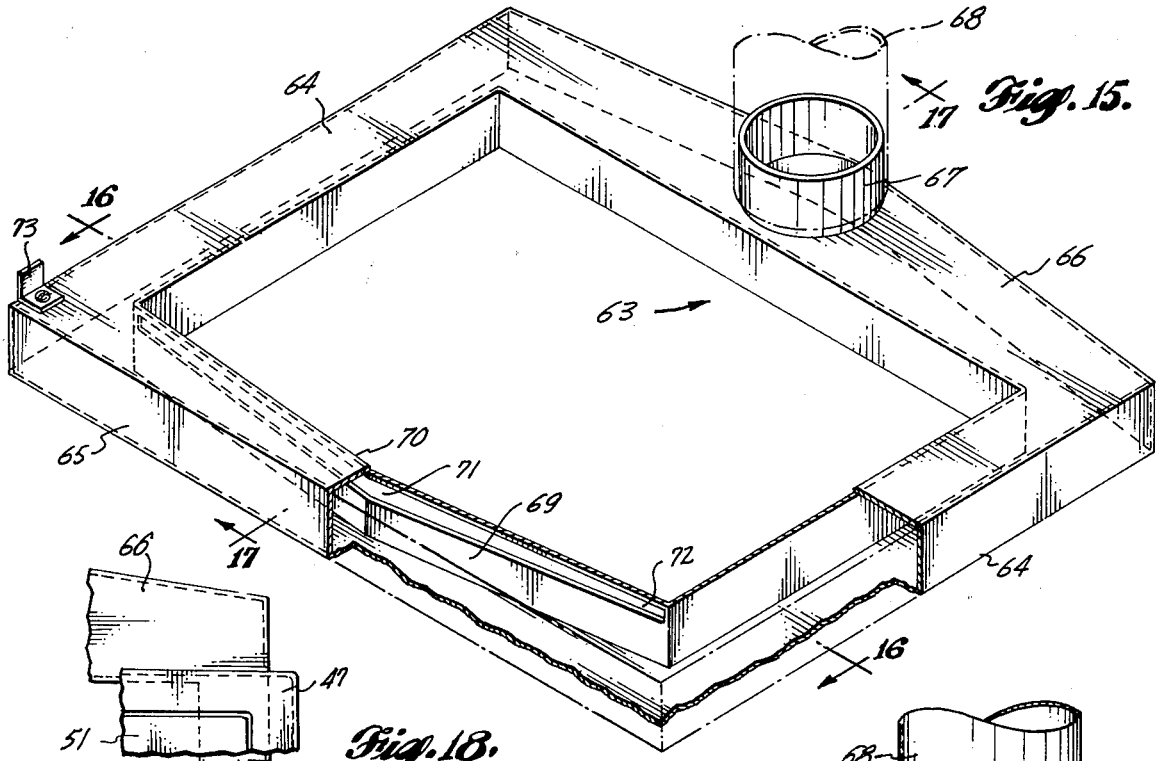
FIG. 15 is a top perspective of another type of effluent gas plenum chamber, having parts broken away.
Figure 16:
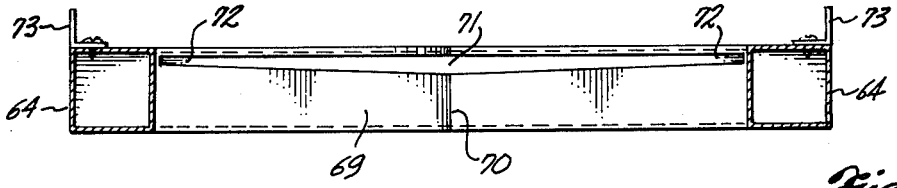
FIG. 16 is a section through such chamber taken on line 16—16 of FIG. 15.

Combustion gas rising from the burner 48 will enter the hollow center of the collector ring 52 shown in FIGS. 12 to 14, or the hollow center of the rectangular loop plenum chamber 63 shown in FIGS. 15 to 17 until it approaches the top of the casing defined by the lid 51. Engagement of combustion gas with the underside of such lid will deflect the combustion gas to flow horizontally outward in all directions to enter the annular slot in the upper portion of the inner wall 53 of the collector ring 52 or forward to enter the slot in the upper portion of the inner wall 69 of the front section 65 of the rectangular plan plenum chamber 63.

In both instances most of the noxious contents of the combustion gas will pass into the plenum chamber around to its rear portion and be discharged through the outlet pipes 57 or 68 instead of passing from the heater casing between the upright rods 49 into the room being heated.

While in many instances the apparatus of the present invention will operate satisfactorily if the effluent combustion gas outlet duct simply forms a chimney providing a natural draft, it is preferred that the outlet duct 16 of FIGS. 1 to 3, 16' of FIGS. 6 to 8, 57 of FIGS. 12 and 13 and 68 of FIGS. 15 and 17 be exhausted positively by a forced draft rather than relying on natural or convection draft, although this is not essential. An efficient and economical blower for effecting positive withdrawal of the effluent combustion gas from the plenum chamber may be of the centrifugal type.

I claim:

1. A catalytic space heater for heating a living space comprising an upright catalytic bed having one surface openly exposed to the living space and having a sheet gas flow of substantially smokeless gaseous combustion products upward alongside said exposed surface, and an elongated plenum chamber having in one wall thereof a slot extending along the upper margin of said upright catalytic bed exposed surface adjacent to one edge of the sheet gas flow, said exposed surface guiding the flow of gas toward said slot for flow of gas from such sheet gas flow through said slot into said plenum chamber, and said plenum chamber having an outlet leading to a location separated from the living space in which the heater is located, said plenum chamber flaring lengthwise of said slot toward said outlet.

2. The apparatus defined in claim 1 in which the slot tapers from such one end toward the outlet of the plenum chamber.

3. A catalytic space heater for heating a living space comprising an upright backing, an upright catalytic bed carried by said backing, having one surface openly exposed to the living space and producing a sheet gas flow of substantially smokeless gaseous combustion products upward alongside said exposed surface, and an elongated plenum chamber sealed to the upper portion of said backing, having horizontally-elongated passage means extending along the upper margin of said upright catalytic bed exposed surface and spanning substantially entirely along the width of such sheet gas flow alongside said exposed surface, said passage means having a width perpendicular to said catalytic bed substantially equal to the thickness of such sheet gas flow perpendicular to said upright catalytic bed, said exposed surface guiding the flow of gas toward said passage means for flow therethrough into said plenum chamber and through said plenum chamber to a location separated from the living space in which the heater is located.

4. The space heater defined in claim 3, and suction means for producing suction in the confining means to increase flow of gas through the passage means.

5. The space heater defined in claim 3, in which the passage means is an elongated slot leading into the plenum chamber.

* * * * *

PO-1050
(5/69)

UNITED STATES PATENT OFFICE
CERTIFICATE OF CORRECTION

Patent No. 3,963,414 Dated June 15, 1976

Inventor(s) Fred H. Jensen

It is certified that error appears in the above-identified patent and that said Letters Patent are hereby corrected as shown below:

Title page, Section 56, add the following to the list of references cited:

--2,806,465 9/1957 Hess.....126/92
3,395,693 8/1968 Cowan.....126/92--

Column 9, line 9, insert a comma after the numeral "1".

Signed and Sealed this

Third Day of May 1977

[SEAL]

*Attest:*

RUTH C. MASON
*Attesting Officer*

C. MARSHALL DANN
*Commissioner of Patents and Trademarks*